United States Patent [19]

Frind et al.

[11] Patent Number: 4,638,283

[45] Date of Patent: Jan. 20, 1987

[54] EXOTHERMICALLY ASSISTED ELECTRIC FUSE

[75] Inventors: Gerhard Frind, Altamont; James J. Carroll, Clifton Park, both of N.Y.; John H. Van Noy, Pittsburgh, Pa.; John G. Leach; Radha K. Ranjan, both of Hickory, N.C.

[73] Assignee: General Electric Company, Schenectady, N.Y.

[21] Appl. No.: 799,711

[22] Filed: Nov. 19, 1985

[51] Int. Cl.[4] ..... H01H 85/04

[52] U.S. Cl. ..... 337/162; 337/401

[58] Field of Search ..... 337/162, 401

[56] References Cited

U.S. PATENT DOCUMENTS

| | | | |
|---|---|---|---|
| 3,705,373 | 12/1972 | Cameron | 337/160 |
| 3,958,206 | 5/1976 | Klint | 337/406 |
| 4,176,385 | 11/1979 | Dethlefsen | 361/58 |
| 4,357,588 | 11/1982 | Leach et al. | 337/160 |
| 4,358,747 | 11/1982 | Zlupko et al. | 337/273 |
| 4,486,734 | 12/1984 | Leach | 337/162 |
| 4,489,301 | 12/1984 | Johnson et al. | 337/401 |

*Primary Examiner*—Harold Broome

*Attorney, Agent, or Firm*—Jeffrey L. Brandt; James C. Davis, Jr.; Paul R. Webb, II

[57] ABSTRACT

An exothermically assisted electric fuse, having at least one exothermic body disposed in heat transfer relationship with at least a portion of each fusible element of the fuse, a triggering circuit for initiating an exothermic reaction in response to an overcurrent through the fuse, and a containment body partially enclosing the exothermic body for directing the heat energy released by the exothermic reaction. The containment body is disposed so as to confine and direct the heat energy in a direction which is substantially perpendicular to a plane containing the portion of the fusible element which is in heat transfer relationship with the exothermic body. In a preferred embodiment of such a fuse, the fusible element is wound around a support so that the fuse windings form the general shape of a cylinder, and the containment body is disposed so that the heat energy is directed in a radial direction with respect to the cylinder formed by the fuse windings. The exothermic body preferably comprises a two-part structure in which a mixture of boron and potassium perchlorate acts as a primer for a larger body of exothermic material formed from a mixture of aluminum and potassium perchlorate.

19 Claims, 10 Drawing Figures

EXOTHERMICALLY ASSISTED ELECTRIC FUSE

BACKGROUND OF THE INVENTION

This invention relates to electric fuses, and more particularly to exothermically assisted electric fuses wherein the heat energy released during exothermically assisted operation is directed toward the fusible element.

Current limiting power interruption in high voltage circuits requires a current interruption device which rapidly brings the current to a zero value upon the occurrence of a line fault. The fuse devices generally considered herein are those employed in electrical circuits typically exhibiting voltages in excess of 1,000 volts. It should be apparent that, for electrical circuits operating at such high energy levels, extensive damage can occur to numerous circuit components and machinery connected to the circuit, or to various other portions of an electrical energy distribution system, if current interruption is not accomplished in a short period of time following the occurrence of various line conditions which draw high current. It is generally desirable to reliably bring such currents to a zero value within the shortest possible time upon the occurrence of an event such as a short circuit line fault.

Conventional high voltage current-limiting fuses generally consist of an electrically conductive fusible element, such as a silver ribbon or wire, wound on a supporting electrically insulative structure. When an overcurrent of a predetermined level flows through the fusible element for a predetermined duration, the fusible element melts at one or more restricted locations along its length, establishing an arc in each region where melting occurs. In this manner, a multiplicity of series-connected arcs is formed in the fuse. Current interruption in this type of fuse occurs when the sum of the individual arc voltages exceeds the voltage applied to the fuse. However, if the overcurrent is relatively small compared to the continuous current rating of the fuse, such as, for example, an overcurrent which is 1.5 times the continuous current rating, the fusible element may melt at only one location, so that only a single arc is created in response to the overcurrent condition. For the fuse to successfully interrupt a high voltage current using a single arc, the arc length must be increased to a relatively long length in a short period of time. For example, to interrupt 15 kV using a single arc, the arc length must be in the range of 25.4 to 76.2 centimeters (10 to 30 inches). Developing such a long arc within the required time is not usually feasible, considering the slowness with which the arc will elongate when the current density is relatively low. Accordingly, it is highly desirable to reliably and simultaneously open the fusible element at a number of positions along its length, so as to create the number of arcs required for interruption.

Various means have been used in the past to establish multiple breaks in a high voltage fusible element in order to facilitate low overcurrent interruption by the fuse. One such means is described in U.S. Pat. No. 4,357,588 to J. G. Leach et al., which is assigned to the same assignee as the present application. In this patent, fusible elements are disclosed which include portions having reduced cross-sectional area. The reduced cross-sectional area portions have a desired fusible time-current characteristic for causing rupturing of the fusible elements, so that the fusible elements disclosed are especially suitable for low overcurrent fault interruption. However, even though the reduced cross-sectional area portions of the disclosed fusible elements make them especially suitable for low current fault interruption, there is still a minimum current density required in the reduced cross-sectional area portions for melting to occur in more than one location. This minimum current density corresponds to a melting time of between 1 and 2 hours. As noted hereinabove, it is desirable that a high voltage fuse be capable of interrupting any current which causes the fusible element to open.

Another approach for achieving multiple breaks in the fusible element in response to persistent overcurrents of low value is to exothermically assist the operation of the fuse, by employing an exothermic material to melt or blast away the fusible element at selected locations along its length upon disruption of the fusible element by an overcurrent condition. For example, exothermically assisted electric fuses are described in U.S. Pat. No. 3,705,373 to F. L. Cameron, U.S. Pat. No. 4,176,385 to R. Dethlefsen, U.S. Pat. No. 3,958,206 to R. V. Klint, and U.S. Pat. No. 4,486,734 to J. G. Leach. The latter two patents are assigned to the same assignee as the present application. Such fuses typically include one or more exothermic bodies disposed in heat transfer relationship with at least a portion of the fusible element of the fuse, and a triggering circuit for initiating an exothermic reaction in the exothermic bodies in response to an overcurrent through the fusible element. The present invention is directed to improving this technique of providing multiple openings in the fusible element, by properly directing the energy released by the exothermic material toward the fusible element. Doing so reduces the amount of exothermic material needed. The present invention is also directed to protecting the exothermic material from the mechanical stresses of fuse assembly.

Accordingly, it is an object of the present invention to provide an exothermically assisted electric fuse in which the heat energy released during exothermically assisted operation is directed toward the fusible element.

Another object of the present invention is to provide an exothermically assisted electric fuse with reduced mechanical stress.

A further object of the present invention to provide an exothermically assisted electric fuse requiring a reduced amount of exothermic material.

SUMMARY OF THE INVENTION

In accordance with a preferred embodiment of the present invention, a high voltage, exothermically assisted electric fuse comprises at least one fusible element connected between a pair of spaced-apart electrically conductive terminals, and a plurality of exothermic bodies disposed closely adjacent to the fusible element at spaced-apart locations along the length of the fusible element. The fuse includes a triggering circuit for initiating an exothermic reaction in the exothermic bodies in response to an overcurrent through the fusible element. Each exothermic body is partially enclosed by a containment body disposed so that the partially enclosed exothermic bodies are in heat transfer relationship with the triggering circuit and with the fusible element, and so that the heating effect of current through the triggering circuit, upon disruption of the fusible element, causes the exothermic bodies to react and cause further disruption of the fusible element at additional locations along the length thereof. The fuse also includes means for supporting the fusible element, the triggering circuit, and the containment bodies so that the exothermic bodies are in heat transfer relationship with the fusible element and the triggering circuit, and so that the triggering circuit is electrically insulated from the fusible element at all points along the length of the fusible element except at the conductive terminals. The containment bodies of the present invention act to confine the heat energy resulting from the exothermic reaction and to direct the heat energy through an opening and toward the fusible element, preferably in a direction which is substantially perpendicular to a plane containing the portion of the fusible element which is in heat transfer relationship with the exothermic body. In one embodiment, the fusible element is wound around a support structure so that the windings of the fusible element form the general shape of a cylinder, and the containment body is disposed so that the heat energy is directed in a radial direction with respect to the cylinder.

BRIEF DESCRIPTION OF THE DRAWINGS

The subject matter which is regarded as the invention is particularly pointed out and distinctly claimed in the concluding portion of the specification. The invention itself, however, both as to its organization and its method of practice, together with further objects and advantages thereof, may best be understood by reference to the following description taken in conjunction with the accompanying drawings, in which:

DETAILED DESCRIPTION OF THE PREFERRED EMBODIMENTS

The present invention provides an exothermically assisted electric fuse of the type having exothermic bodies disposed in heat transfer relationship with the fusible element of the fuse, and also having a triggering circuit for initiating an exothermic reaction in the exothermic bodies in response to a disruption of the fusible element. As noted hereinabove, several such exothermically assisted fuses are known in the art.

Figures 1, 5, 6, 7, 10:
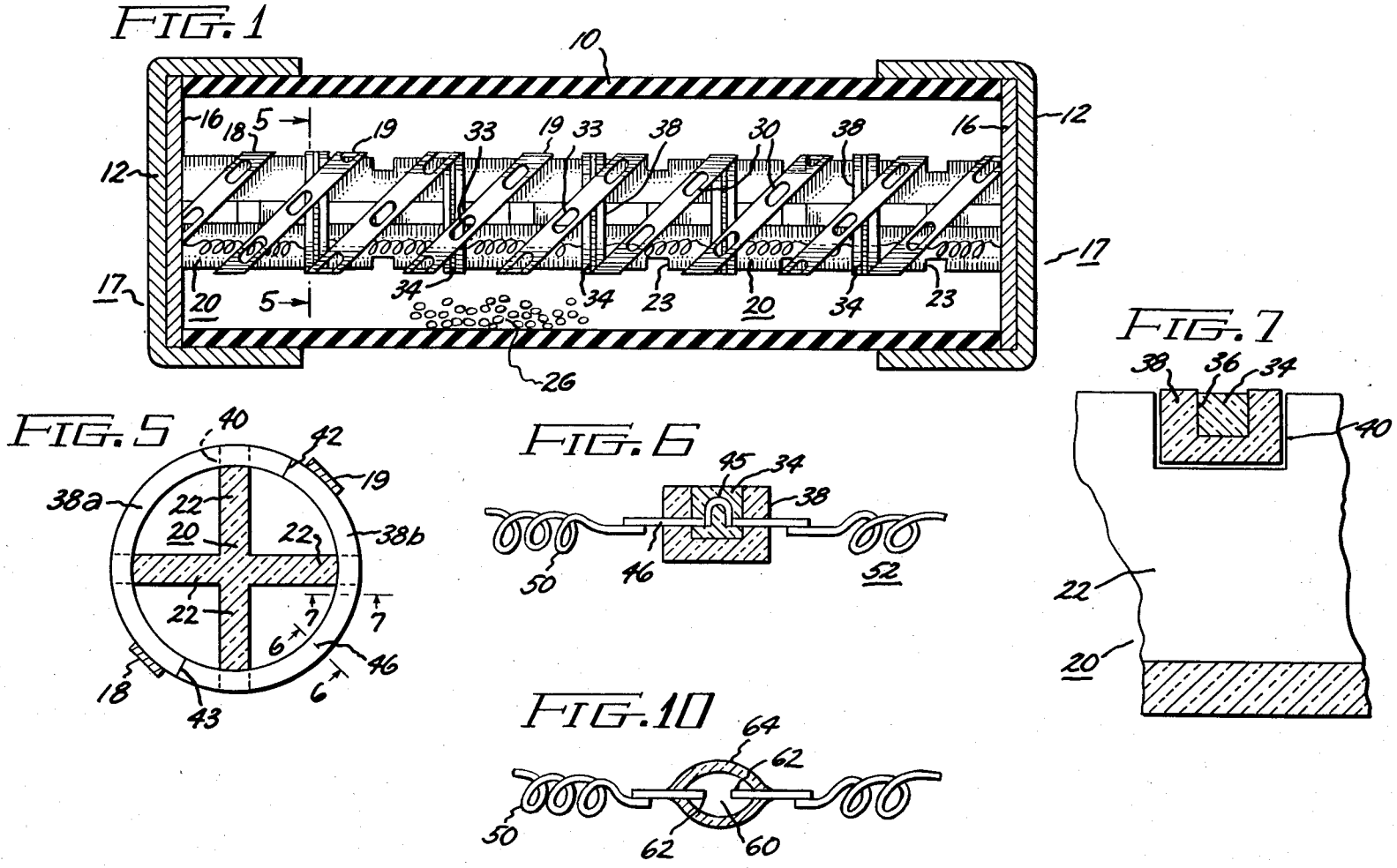
FIG. 1 is a side elevation, cross-sectional view schematically illustrating an exothermically assisted electric fuse in accordance with one embodiment of the present invention.
FIG. 5 is a cross-sectional view of the fuse shown in FIG. 1, taken along line 5—5.
FIG. 6 is a cross-sectional view of the fuse apparatus shown in FIG. 5, taken along line 6—6.
FIG. 7 is a cross-sectional view of the fuse apparatus shown in FIG. 5, taken along line 7—7.
FIG. 10 is a side elevation, partial cross-sectional view schematically illustrating an alternative embodiment for the trigger circuit shown in FIG. 6.

As schematically illustrated in FIG. 1, the present exothermically assisted electric fuse comprises a tubular casing 10 of electrically insulative material and two conductive end caps 12 mounted on the casing at its respective opposite ends. Clamped between each end cap 12 and the corresponding end of casing 10 is a conductive terminal plate 16. End cap 12 and terminal plate 16 taken together constitute a fuse terminal 17. While a single conductive fusible element might be employed, there is shown extending between spaced-apart fuse terminals 17 and electrically connected thereto two electrically conductive fusible elements 18 and 19, with elements 18 and 19 being connected electrically in parallel with each other. Fusible elements 18 and 19 are supported in position by a support 20 of electrically insulative material. Support 20 is located along the central axis of casing 10 and extends between terminals 17, with support 20 being suitably attached to terminals 17 by any conventional means. As is schematically illustrated in FIG. 5, which is a cross-sectional view taken along line 5—5 of FIG. 1, support 20 has a cross-shaped transverse cross-section in the embodiment shown in FIG. 1. Support 20 comprises four fins 22 radiating from the central region of support 20, with each fin 22 extending along the length of support 20 between terminals 17. Preferably, fusible elements 18 and 19 are spirally or helically wound about support 20 in spaced-apart relationship to each other. In order to improve the ability of support 20 to withstand voltages applied along the length thereof, a number of notches 23 are provided in the radially outer edges of fins 22, to provide added creepage distance in the direction of the length of support 20, along the radially outer edges thereof. If necessary, the ability of support 20 to withstand applied voltage may be further improved by adding still more notches 23 along the outer edges of fins 22, with at least one notch 23 being interposed between adjacent fusible elements 18 and 19 at each location where elements 18 and 19 contact support 20. Although not shown in FIG. 1 for the sake of simplicity, fusible elements 18 and 19 are electrically connected to terminals 17 in a suitable conventional manner. For example, an extended portion of each end of fusible elements 18 and 19 may be clamped between the associated end cap 12 and adjacent terminal plate 16.

Each of fusible elements 18 and 19 has perforations 30 located at spaced locations along its length, in order to form a plurality of reduced cross-sectional area regions in fusible elements 18 and 19. While perforations 30 have been shown in FIG. 1 as being oval in shape, some or all of perforations 30 may also be formed in other appropriate shapes, such as, for example, circles or rectangles. Furthermore, the reduced cross-sectional areas can be formed by employing notches in the sides of fusible elements 18 and 19, in place of perforations 30 in the middle portion thereof. In the event of an overcurrent through fusible elements 18 and 19, the current density at these regions of reduced cross-sectional area is increased to a sufficient level to cause melting and vaporization of the fusible element, so that series-related arcs are formed at corresponding locations along the length of fusible elements 18 and 19. Furthermore, to assist in initiating fuse operation for low level overcurrents, each of fusible elements 18 and 19 are preferably provided with at least one conventional "M-effect" producing overlay 33, with each overlay 33 being disposed adjacent to one of perforations 30. When fusible elements 18 and 19 are heated by an overcurrent that persists for a predetermined duration, overlays 33 begin to melt and to alloy with the underlying material of fusible elements 18 and 19. Overlay 33 is composed of a material which, when alloyed with the material of the fusible element, increases the electrical resistance of the fusible element at the locations where alloying takes place. The increased resistance, in turn, accelerates melting and vaporization of fusible elements 18 and 19 at these locations, thereby reducing the time required to form associated arcs.

In the preferred fuse embodiment shown in FIG. 1, insulative casing 10 is filled with granular arc-extinguishing material 26, such as, for example, quartz sand. Arc-extinguishing material 26 surrounds fusible elements 18 and 19 on all sides except where elements 18 and 19 are in contact with support 20 and where elements 18 and 19 are in contact with exothermic bodies 34. Arc-extinguishing material 26 serves in a conventional manner to cool arcing products and to extinguish the arcs that are developed when fusible elements 18 and 19 are disrupted, in order to complete the current interruption process.

As pointed out hereinabove, it is not usually feasible to interrupt a low level overcurrent in a high voltage circuit when only a single arc is formed along the length of fusible elements 18 and 19. Accordingly, an exothermically assisted fuse includes at least one and preferably a plurality of exothermic bodies 34 for rapidly producing additional arcs in series with the first arc, to assist in interrupting the low level overcurrent. Exothermic bodies 34 are located along the length of support 20 and are disposed so that an exothermic reaction in bodies 34 results in melting or otherwise disrupting fusible elements 18 and 19.

Figure 2:
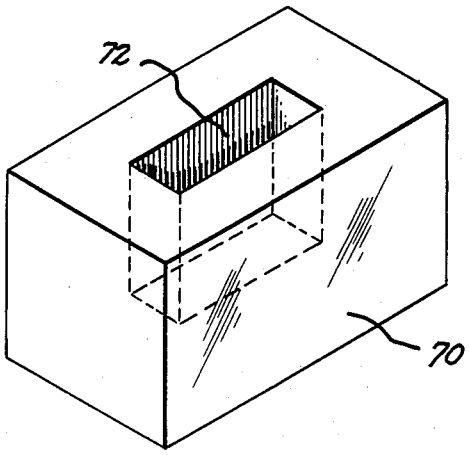
FIG. 2 is a perspective view schematically illustrating one embodiment of a containment body for directing the heat energy developed during exothermically assisted operation of an electric fuse, in accordance with the present invention.
Figure 3:
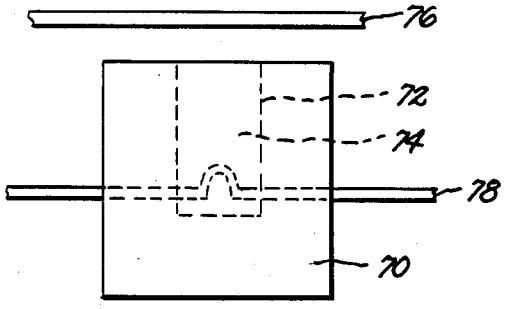
FIG. 3 is an end view of the containment body shown in FIG. 2, schematically illustrating the relationship of the containment body to the elements of an exothermically assisted fuse.

Referring now to FIG. 2, in one embodiment, a containment body 70 has a containment chamber 72 defined therein. As schematically illustrated in FIG. 3, containment chamber 72 partially encloses an exothermic body 74. Containment body 70 is disposed so that exothermic body 74 is located in heat transfer relationship with at least a portion of fusible element 76. Triggering circuit 78 is disposed in relation to exothermic body 74 so that triggering circuit 78 initiates an exothermic reaction in exothermic body 74 in response to an overcurrent through fusible element 76. Containment body 70 and containment chamber 72 are further disposed so as to confine the heat energy resulting from the exothermic reacton in exothermic body 74, and so as to direct the heat energy in a direction which is substantially perpendicular to a plane containing the portion of fusible element 76 which is in heat transfer relationship with exothermic body 74. As illustrated in FIG. 1 and described in detail below, a fuse of the type contemplated by the present invention includes a pair of spaced-apart electrically conductive terminals, with fusible element 76 being connected therebetween, and also includes means for supporting fusible element 76, triggering circuit 78, and containment body 70 in the above-described relationship with one another.

Figure 4:
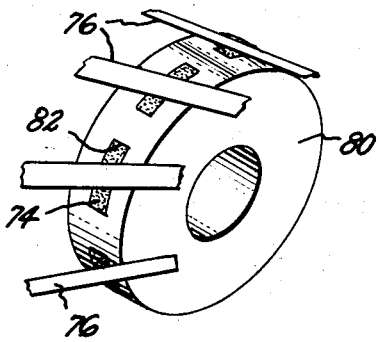
FIG. 4 is a perspective view schematically illustrating another embodiment of a containment body in accordance with the present invention.

FIG. 4 schematically illustrates an embodiment of the present invention which is particularly useful for fuses of the type shown in FIG. 1. For such an embodiment, fusible element 76 is wound around a support (not shown in FIG. 4) so that the windings of fusible element 76 form the general shape of a cylinder, and containment body 80 and containment chambers 82 are disposed so that heat energy resulting from an exothermic reaction in exothermic bodies 74 is directed in a radial direction with respect to the cylinder formed by the fusible element windings. In the embodiment illustrated in FIG. 4, a plurality of containment chambers 82 are formed in the radially outer surface of disc-shaped containment body 80, with containment chambers 82 having locations around the circumference of containment body 80 which correspond to the circumferential locations of the windings of fusible element 76. In an alternative embodiment to that shown in FIG. 4, containment chamber 82 extends around the entire circumference of containment body 80, so that heat energy produced by reaction of exothermic body 74 is directed in all radial directions around the circumference of the cylinder formed by the windings of fusible element 76.

An embodiment of the present invention which is especially suitable for the exothermically assisted fuse shown in FIG. 1 is schematically illustrated in FIG. 7. For the embodiment shown therein, containment body 38 comprises an annulus having groove 36 in the radially outer surface thereof, with groove 36 extending around the outer circumference of annulus 38, and with the open side of groove 36 facing radially outwardly. For this embodiment, each exothermic body 34 conveniently comprises an annularly shaped ring disposed in groove 36. The fuse embodiment of FIG. 1 employs a plurality of containment bodies 38, with each containment body 38 partially enclosing at least one exothermic body 34. Containment bodies 38 are attached to support 20 so that containment bodies 38 are longitudinally spaced apart from one another along the length of support 20, and so that fusible elements 18 and 19 pass by the non-enclosed portions of exothermic bodies 34 in close proximity thereto. Preferably, as illustrated in FIG. 1, each of fusible elements 18 and 19 passes by the non-enclosed portion of each of exothermic bodies 34 at least once. Each containment body 38 is disposed so that the heat energy developed by an exothermic reaction in body 34 is directed in a radial direction with respect to support 20. In the embodiment of FIG. 1, each containment body 38 is further disposed so that the heat energy is directed in all radial directions around the circumference of support 20. With containment bodies 38 being disposed in this manner, exothermic bodies 34 are located closely adjacent to fusible elements 18 and 19 at spaced-apart locations along the length of elements 18 and 19. Hence, an exothermic reaction in bodies 34, caused by current flow through an associated triggering circuit in response to disruption of fusible elements 18 and 19, produces further disruption of elements 18 and 19 at positions respectively located adjacent to exothermic bodies 34. For each exothermic body 34, initiation of the exothermic reaction causes all of the parallel-connected fusible elements to be broken. Thus, the design of FIG. 1 may be used for fuses having additional fusible elements wrapped around support 20 in the manner shown by fusible elements 18 and 19, as is typical for fuses having a higher current rating than the fuse shown in FIG. 1. The additional fusible elements are connected electrically in parallel with elements 18 and 19, and each additional fusible element crosses each of exothermic bodies 34 at least once. Since the exothermic reaction in bodies 34 occurs very rapidly, all of the fusible elements are broken substantially simultaneously.

Furthermore, with containment bodies 38 and exothermic bodies 34 disposed in the manner illustrated in FIG. 1, each exothermic body 34 is located in a plane that is substantially perpendicular to the direction of the electric field across the arc formed at the respective disruption of the fusible element. An exothermic reaction in body 34 causes the fusible element to melt, and an associated arc to be formed, at a location aligned with exothermic body 34. Conduction of current through the arc causes the fusible element to burn back along its length, away from exothermic body 34. After the arc has been extinguished, in order to complete the current interruption function, the electric field between the spaced-apart ends of the remaining portions of the fusible element extends in a direction that is substantially longitudinal with respect to the ends of the fusible element. The portion of exothermic body 34 that is located between the ends of the fusible element therefore lies in a plane which extends transversely to the direction of the electric field. This orientation of exothermic body 34 with respect to the electric field helps prevent the exothermic material from forming a potential breakdown path along the electric field gradient of the fuse.

As illustrated in FIG. 7, each containment body 38 may be conveniently attached to support 20 by being mounted in slots 40 in the radialy outer surfaces of fins 22. For such an embodiment, containment body 38 conveniently comprises two semi-circular portions 38*a* and 38*b*, in the manner illustrated in FIG. 5. Semi-circular portions 38*a* and 38*b* are suitably held together by conventional means to form a complete ring. For example, the opposed ends of portions 38*a* and 38*b* may be welded or bonded together at the locations designated in FIG. 5 by reference numerals 42 and 43.

FIG. 6 schematically illustrates one embodiment of a triggering circuit which may be employed in the present invention. For igniting exothermic bodies 34, a plurality of conductive heating portions 45 of the triggering circuit are respectively located in close proximity to exothermic bodies 34, with at least one of heating portions 45 being located in close proximity to each of exothermic bodies 34. Heating portions 45 are electrically connected in series with each other, so that current flowing through the triggering circuit flows through each of heating portions 45. As illustrated in FIG. 6, each heating portion 45 may conveniently comprise a loop of high resistivity wire embedded in exothermic body 34. When significant current is passed through this high resistivity wire, it is heated and the resultant heat is transferred to the surrounding body of exothermic material, thereby producing an exothermic reaction that very rapidly generates hot gases flowing radially outwardly out of containment chamber 36. These hot gases quickly heat the portions of fusible elements 18 and 19 which are in heat transfer relationship with exothermic body 34, causing fusible elements 18 and 19 to melt in the regions adjacent to exothermic bodies 34 and to form a series of arcs along the length of elements 18 and 19. This disruption of fusible elements 18 and 19 is accelerated by directing the abruptly developed forces, produced by the hot gases, in a direction which is substantially perpendicular to the portions of fusible elements 18 and 19 which are located adjacent exothermic bodies 34.

Preferably, the triggering circuit further comprises interconnecting portions electrically connected in series with heating portions 45, with the interconnecting portions being connected between pairs of heating portions 45 and also between heating portions 45 and fuse terminals 17. In the embodiment of FIG. 6, each interconnecting portion comprises terminal conductor 46 and coiled wire 50. Each terminal conductor 46 extends in sealed relationship through containment body 38 into containment chamber 36, for electrical connection to heating portion 45. Each wire 50 is disposed in coil form so as to impart the desired length to the triggering circuit, and wire 50 may be connected to terminal conductor 46, by, for example, a crimp connection. Terminal conductors 46 and coiled wires 50 each have a substantially larger cross-sectional area than that of heating portion 45. Preferably, terminal conductors 46 and coiled wires 50 are formed from an oxidation-resistant material having a low electrical resistivity, such as silver or silver alloy. Providing terminal conductors 46 and coiled wires 50 with a larger cross-sectional area and a lower electrical resistivity than that of heating portion 45 assures that, when significant current passes through the triggering circuit, the heating effect of the current will be concentrated at heating portions 45. Doing so helps to prevent melting of the triggering circuit at locations outside heating portions 45 before exothermic bodies 34 are ignited, which melting could interfere with the desired operation of the triggering circuit.

The series combination of coiled wires 50, terminal conductors 46, and heating portions 45 constitute triggering circuit 52. Triggering circuit 52 has its opposite ends suitably electrically connected to opposite fuse terminals 17. Accordingly, triggering circuit 52 provides an electrically conductive path between terminals 17, which path is parallel to the electrical paths provided by fusible elements 18 and 19. Triggering circuit 52 has an electrical resistance which is much higher than the electrical resistance of fusible elements 18 and 19. Therefore, if triggering circuit 52 is electrically insulated from fusible elements 18 and 19 at all points along their lengths except at terminals 17, no significant current flows through triggering circuit 52 as long as one of fusible elements 18 and 19 remains intact. In the event that fusible elements 18 and 19 are disrupted, by melting, vaporization, or mechanical breaking, triggering circuit 52 is the only electrically conductive path available between terminals 17, and the current through triggering circuit 52 accordingly abruptly increases. This abrupt increase in current through triggering circuit 52 causes exothermic bodies 34 to be heated and to develop the exothermic reactions described hereinabove.

The energy-releasing reaction in each exothermic body 34 disrupts not only fusible elements 18 and 19, but also triggering circuit 52 at each of exothermic bodies 34. As a result of this disruption of triggering circuit 52, a gap is formed within each exothermic body 34, across which gap an arc is developed. These short gaps in triggering circuit 52 continue to arc while the current in triggering circuit 52 heats the remaining portions thereof, until the remainder of triggering circuit 52 also melts and arcs. The arc-extinguishing material surrounding triggering circuit 52 then interacts with the arcing products to effect arc extinction, and, in the case of interrupton of a low level overcurrrent, to develop an insulating gap capable of withstanding the applied recovery voltage. In the case of low level overcurrents, the fuse is designed so that fusible elements 18 and 19 are fully severed at multiple locations before the current through triggering circuit 52 is extinguished. The total voltage of the arcs along fusible elements 18 and 19 is then high enough to withstand the recovery voltage and, thus, to complete the current interruption function. With higher level overcurrents, disruption of triggering circuit 52 and extinction of the triggering circuit arcs occur very rapidly, and current through the fuse is commutated back to fusible elements 18 and 19. At that point, the gaps in fusible elements 18 and 19, formed as a result of the exothermic reaction in bodies 34, are still relatively short. As a result, current continues to flow through fusible elements 18 and 19. However, for high level overcurrents, these arcs in fusible elements 18 and 19 quickly elongate to a sufficient length that the total arc voltage exceeds the applied recovery voltage, so that the fuse readily clears in a short period of time.

Figure 8:
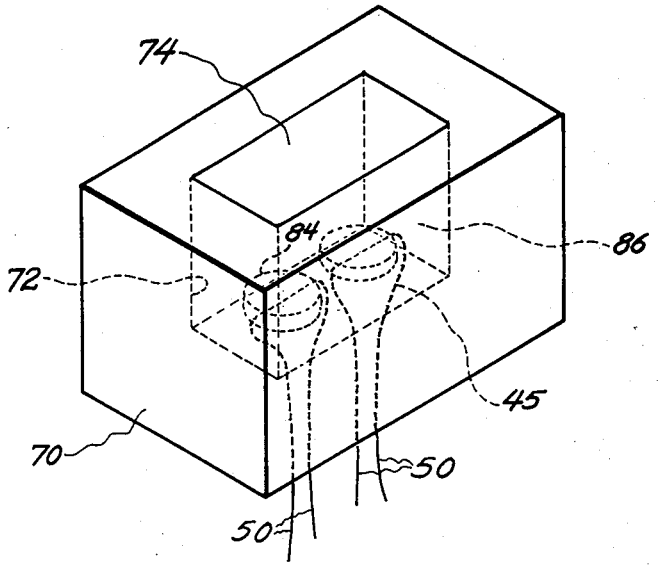
FIG. 8 is a perspective view schematically illustrating a preferred embodiment of an exothermic body, in accordance with the present invention.
Figure 9:
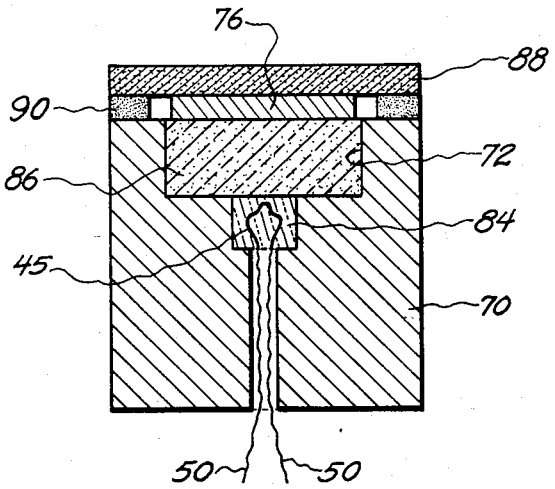
FIG. 9 is a side elevation, cross-sectional view schematically illustrating yet another embodiment of the present invention, in which a gas-evolving member is attached to the containment body.

In accordance with the present invention, each exothermic body 34 preferably comprises a two-part structure, of the type schematically illustrated in FIGS. 8 and 9 by exothermic body 74. As shown therein, exothermic body 74 preferably comprises at least one primer body 84 disposed in heat transfer relationship with the triggering circuit. In the embodiment shown in FIG. 8, two primer bodies 84 are employed, with each body 84 being disposed in heat transfer relationship with an associated heating portion 45 of the trigger circuit. Primer bodies 84 are formed from a material which releases energy in response to the heating effect of current flowing through heating portions 45. Exothermic body 74 also comprises main body 86 disposed in heat transfer relationship with each of primer bodies 84. Main body 86 is formed from a material which exothermically produces heat energy in response to the energy released by primer bodies 84. In the particular embodiment illustrated in FIG. 8, primer bodies 84 and main body 86 are further disposed so that each primer body 84 at least partially surrounds at least one of heating portions 45 of the trigger circuit, and so that main body 86 at least partially surrounds each of primer bodies 84. In operation, primer bodies 84 act to ignite the exothermic material in main body 86, thereby more readily initiating the desired exothermic reaction in response to current flowing through the trigger circuit.

During exothermically assisted operation of the fuse of the present invention, gases resulting from the reaction of the exothermic material may contaminate the electric arcs formed along the length of the fusible element, making it more difficult to extinguish the arcs and to reduce the current flowing through the fuse to zero. To overcome any effect the exothermic material gases might have on arc extinction, the fuse of the present invention preferably further comprises means for providing an arc-extinguishing gas to the fuse element, at the locations where the arcs occur. The means employed is disposed so that the arc-extinguishing gas assists in extinguishing the arcs, along the length of the fusible element, that are formed as a result of the disruption of the fusible element, caused by the exothermic reactions in each of the exothermic bodies. In one embodiment, the means for providing an arc-extinguishing gas comprises at least one gas-evolving member associated with the fusible element, in the manner illustrated in FIG. 9. Gas-evolving member 88 is formed from a material which evolves an arc-extinguishing gas when exosed to an electrical arc, and is disposed sufficiently close to the fusible element so that exposure of member 88 to the arcs formed along the length of the fusible element causes arc-extinguishing gas to be evolved from member 88. In the embodiment illustrated in FIG. 9, a plurality of gas-evolving members 88 is employed in the fuse, with each containment body 70 having at least one of gas-evolving members 88 associated therewith. Member 88 is disposed with respect to containment body 70 so that the portion of fusible element 76 which is adjacent to the exothermic body, which body is shown in FIG. 9 as a two-part structure comprised of primer body 84 and main body 86, is located between containment body 70 and gas-evolving member 88. With containment body 70, fusible element 76, and gas-evolving member 88 so disposed, the heat energy released by a reaction in the exothermic material of main body 86 causes a portion of fusible element 76 to melt. An electric arc is then formed between the adjoining ends of the non-melted portions of element 76, which arc burns sufficiently close to gas-evolving member 88 to quickly heat member 88 to a high temperature and to cause gases or vapors to be released therefrom. These gases or vapors assist in extinguishing the arc, in order to bring the current through fusible element 76 to a zero value. In the embodiment illustrated in FIG. 9, member 88 is attached to containment body 70 by adhesive material 90, so that fusible element 76 is retained in position relative to main body 86 of the exothermic material. Adhesive material 90 may comprise any suitable resin, such as, for example, an epoxy.

Preferably, gas-evolving member 88 is formed from a material which is capable of evolving the required quantities of arc-extinguishing gases when heated by the arc, but which evolves substantially no gases at the temperature reached by member 88 prior to initiation of an arc, during prolonged overcurrents through fusible element 76. In a preferred embodiment, member 88 is formed primarily of a baked material, a major portion of which is hydrated aluminum silicate including water of hydration that is released only at temperatures in excess of those attained by member 88 during prolonged overcurrents through fusible element 76. The material is baked for several hours at temperatures up to at least the temperature reached by member 88 during these prolonged overcurrents through the fuse. One such material is formed primarily of hydrated aluminum silicate in the form of kaolin clay, in the manner disclosed in U.S. Pat. No. 4,358,747 to Zlupko et al., which is assigned to the same assignee as the present application. The inorganic material disclosed in that patent is baked for a substantial period at a temperature level exceeding the temperature that the material will be exposed to prior to initiation of an arc, but at a temperature level sufficiently low that the kaolin clay retains most of its water of hydration. Thus, a large amount of water of hydration is available to be released as vapors when the material is heated by the arc, to provide the desired arc-extinguishing gas. Another advantage of employing a completely inorganic material is that the material is not susceptible to tracking as a result of arcing or other forms of electrical discharge. As a result, the surface of the material maintains its dielectric strength and does not form dielectrically weak paths across the gaps formed in the fusible element as a result of fuse operation.

In many applications of high voltage current-limiting fuses, the fuse is exposed to surge currents from switching surges and similar transient conditions. Such surge conditions can produce false operation of the fuse, because, even though the surge currents are of short duration and do not supply sufficient energy to fusible elements 18 and 19 to cause them to melt, the surge currents have sufficient instantaneous values to develop substantial voltages between fuse terminals 17. Such voltages might drive sufficient current through triggering circuit 52 to ignite exothermic bodies 34. In order to prevent such false operation of the fuse, the fuse embodiment of FIG. 1 preferably further comprises surge blocking means electrically connected in series with triggering circuit 52, for substantially blocking current from flowing through triggering circuit 52 under predetermined switching surge conditions. The surge blocking means is further configured so as to electrically break down and allow current to flow through triggering circuit 52 when the voltage across the surge blocking means exceeds a predetermined level. As schematically illustrated in FIG. 10, in one embodiment, the surge-blocking means comprises electrical breakdown gap 60 between two spaced-apart electrodes 62. Electrodes 62 are located within housing 64 formed of electrically insulative material. The spacing between electrodes 62 is chosen so that gap 60 has sufficient dielectric strength to withstand the voltage developed between fuse terminals 17 by the switching surges and other transient conditions described hereinabove. In this manner, such surges are prevented from producing significant current through triggering circuit 52.

Breakdown gap 60 does not significantly interfere with the desired operation of the fuse. If fusible elements 18 and 19 melt and form arcs at overlays 33 in response to a persistent low level overcurrent, current flows through the arcs until the next zero level crossing of the current waveform. The usual recovery voltage then appears across the arcing gaps in fusible elements 18 and 19. At this point, these gaps may not be long enough to have a dielectric strength as high as that of breakdown gap 60, in which case the recovery voltage would break down the gaps in fusible elements 18 and 19, thereby re-establishing the arcs that had been present in the previous cycle of the current waveform. The re-established arcs would burn back fusible elements 18 and 19, thereby lengthening the gaps and increasing their dielectric strength. This process would be repeated until the gaps in fusible elements 18 and 19 become long enough to have a dielectric strength which is higher than that of breakdown gap 60. At that point, gap 60 breaks down and allows current to flow through triggering circuit 52, thereby activating exothermic bodies 34 in the manner described hereinabove. In the case of a higher level overcurrent, the process would be accelerated. The arcs that initially form in fusible elements 18 and 19 would quickly become long enough to have a breakdown voltage exceeding that of breakdown gap 60, so that the recovery voltage would cause current to flow in the triggering circuit after the first, or at least an early, zero level crossing of the current waveform.

Although only one triggering circuit 52 is shown in the fuse embodiment illustrated in FIG. 1, it is to be understood that a plurality of such triggering circuits may also be employed. To increase the reliability of the fuse, a second triggering circuit may be connected between fuse terminals 17 electrically in parallel with first triggering circuit 52 and also with fusible elements 18 and 19. Like first triggering circuit 52, the second triggering circuit serves the function of initiating an exothermic reaction in exothermic bodies 34 in response to an overcurrent through fusible elements 18 and 19. Preferably, the second triggering circuit is of the same design as triggering circuit 52 shown in the Figures. The second triggering circuit is electrically insulated from fusible elements 18 and 19 at all points along their length except at fuse terminals 17, and the second triggering circuit has an electrical resistance that limits current therethrough to very low values until fusible elements 18 and 19 are disrupted. The second triggering circuit is also disposed in heat transfer relationship with exothermic bodies 34, so that the heating effect of current through the second triggering circuit, upon disruption of fusible elements 18 and 19, causes exothermic bodies 34 to react and to cause further disruption of elements 18 and 19 along their lengths. Preferably, this second triggering circuit also has heating portions in the form of high resistivity wires embedded in exothermic bodies 34, in the manner illustrated in FIG. 6. In such an arrangement of the two triggering circuits, the current flowing through the fuse after fusible elements 18 and 19 are disrupted divides between the two triggering circuits. If, for some reason, either triggering circuit operates before the other, the resulting exothermic reactions will disrupt the other triggering circuit as well as fusible elements 18 and 19. As a result, a fuse having a plurality of triggering circuits 52 operates in the basic manner intended and described hereinabove, even if one or more trigger circuits fail.

The exothermically assisted electric fuse illustrated and described herein may employ a wide variety of materials for its various components. As examples, and not by way of limitation, fusible elements 18 and 19 may comprise aluminum, silver, copper, tin, zinc, or cadmium, with aluminum and silver being preferred. For triggering circuit 52, coiled wires 50 may comprise silver or silver alloy, terminal conductors 46 may comprise nickel, chromium, or copper-nickel alloys, and heating portions 45 may comprise tungsten or nickel-chromium alloy. Arc-extinguishing material 26 preferably comprises quartz sand, but other arc-extinguishing materials may also be used, such as oil or a suitable gas. Containment body 38 may be formed from a wide variety of materials meeting the mechanical strength and temperature requirements of a particular application, and is preferably formed so that at least the radially outer surface thereof is electrically insulative. The material used for exothermic bodies 34 preferably comprises one of the materials described in U.S. Pat. No. 4,489,301 to W. T. Grubb et al., which is assigned to the same assignee as the present application. Accordingly, each exothermic body 34 preferably comprises a mixture of a solid oxidant, a metal in powdered form, and a suitable binder. The metal may be selected from the group consisting of hafnium, thorium, aluminum, magnesium and combinations thereof. The oxidant comprises a material such as potassium perchlorate or other chlorates or perchlorates which react exothermically with the metal when the mixture is heated. The binder may be composed of colloidal silica. Preferably, exothermic bodies 34 are covered with a thin coating of a moisture-resistant insulating material such as sodium silicate. When the two-part structure illustrated in FIGS. 8 and 9 is employed for exothermic body 74, primer body 84 preferably comprises a mixture of boron and potassium perchlorate, and main body 86 preferably comprises a mixture of aluminum and potassium perchlorate. The aluminum employed in the mixture of main body 86 preferably comprises aluminum particles having a diameter of less than about 5 microns. For example, boron and potassium perchlorate may be mixed with colloidal silica to form a paste which is applied to heating portions 45 of the trigger circuit, and the remainder of containment chamber 72 may be filled with a mixture of aluminum, potassium perchlorate, and colloidal silica. The material used for gas-evolving member 88 may comprise a baked material which is the reaction product of a mixture of ingredients comprising hydrated aluminum silicate in the form of kaolin clay, boron phosphate, and an aqueous binder, with the mixture being baked for several hours at temperatures gradually raised to about 350° C. and thereafter maintained between 350° C. and 400° C. While boron phosphate is not a necessary ingredient in this mixture, the presence of boron phosphate in member 88 appears to aid in current interruption in the fuse. The decomposition products of boron phosphate, formed during heating of the material by the arc, have a high electron affinity, and thereby contribute to an increased rate of dielectric recovery after the current through the fuse has reached a zero value. The mixture of ingredients may also include a minor percentage of inorganic filler. One such filler is milled zircon.

The foregoing describes an exothermically assisted electric fuse wherein the heat energy released during the exothermically assisted operation is directed toward the fusible element. By providing means for directing the exothermic energy, the present invention further provides an exothermically assisted fuse requiring a reduced amount of exothermic material. The apparatus of the present invention also protects the exothermic bodies from mechanical stress during fuse assembly and operation.

While the invention has been described in detail herein in accordance with preferred embodiments thereof, many modifications and changes may be effected by those skilled in the art. For example, containment body 70 has been shown in FIGS. 2 and 3 as a rectangular solid, and containment body 80 has been shown in FIG. 4 as a disc. However, other shapes may also be employed, as long as they provide the desired function of confining and directing the heat energy released during the exothermically assisted operation of the fuse, in the manner described hereinabove. Also, although fusible elements 18, 19, and 76 have been shown in the Figures as being in the form of ribbons, other forms may also be used, such as, for example, wires having a circular cross-section. Accordingly, it is intended by the appended claims to cover all such modifications and changes as fall within the true spirit and scope of the invention.

The invention claimed is:

1. An exothermically assisted electric fuse comprising:

a pair of spaced-apart electrically conductive terminals;

a fusible conductive element connected between said terminals;

an exothermic body disposed adjacent to said fusible element, said exothermic body formed from material which exothermically reacts when heated to a predetermined temperature;

a triggering circuit connected between said terminals independently of said fusible element for initiating an exothermic reaction in said exothermic body in response to a disruption of said fusible element;

a containment body partially enclosing said exothermic body so as to confine the heat energy resulting from said exothermic reaction and to direct said heat energy in a predetermined direction; and means for supporting said fusible element, said triggering circuit, and said containment body such that said exothermic body is in heat transfer relationship with both said fusible element and said triggering circuit so that upon disruption of said fusible element said heat energy generated by said exothermic reaction is directed by said containment body at said fusible element for causing additional disruptions therein.

2. The fuse of claim 1 wherein:

said containment body includes an opening; and said fusible element is disposed across said containment body opening such that said heat energy is directed toward said fusible element.

3. The fuse of claim 2 wherein said support means includes a support of electrical insulating material about which said fusible conductive element is spirally wound;

a second fusible conductive element in addition to said first-recited fusible conductive element being connected between said terminals and spirally wound about said support in parallel-circuit relationship with said first element and in spaced-apart relationship to said first element;

a plurality of said containment bodies being located on said support in axially-spaced relationship along the length of said support, each of said containment bodies containing one of said exothermic bodies;

said fusible elements passing over said openings of said exothermic bodies; and means for electrically insulating said triggering circuit from said fusible elements at all points along the length of said fusible elements except at said terminals.

4. The fuse of claim 3 wherein said triggering circuit includes a plurality of conductive heating portions respectively located in close proximity to said plurality of exothermic bodies and electrically connected with each other in said triggering circuit.

5. The fuse of claim 3 wherein each of said fusible elements passes at least once over said opening of each of said containment bodies.

6. The fuse of claim 3 wherein:

the windings of said fusible elements form the general shape of a cylinder; and each of said containment bodies is disposed so that said heat energy is directed in a radial direction with respect to said cylinder.

7. The fuse of claim 6, wherein:

each of said containment bodies comprises an annulus having a groove in the radially outer surface thereof, said groove extending around the outer circumference of said annulus; and said exothermic body comprises an annularly shaped ring disposed in said groove.

8. The fuse of claim 6 wherein:

each of said containment bodies comprises an annulus having a plurality of separate grooves disposed circumferentially around the radially outer surface thereof; and one of said exothermic bodies is disposed in each of said grooves.

9. The fuse of claim 2 wherein:

a plurality of said containment bodies are spaced apart along the length of said fusible element, each of said containment bodies including one of said exothermic bodies;

said fusible element passes at least once over a respective one of said openings on each of said containment bodies;

said triggering circuit includes a plurality of conductive heating portions respectively located in close proximity to said plurality of exothermic bodies and electrically connected in series with each other in said triggering circuit; and means for electrically insulating said triggering circuit from said fusible element at all points along the length of said fusible element except at said terminals.

10. The fuse of claim 9 wherein:

said support means includes a support of electrical insulating material about which said fusible conductive element is spirally wound;

a second fusible conductive element in addition to said first-recited fusible conductive element being connected between said terminals and spirally wound about said support in parallel-circuit relationship with said first element and in spaced-apart relationship to said first element;

a plurality of said containment bodies being located on said support in axially-spaced relationship along the length of said support, each of said containment bodies containing one of said exothermic bodies; and said fusible elements passing over said openings of said exothermic bodies.

11. The fuse of claim 9 wherein said triggering circuit further includes interconnecting portions between said heating portions, said interconnecting portions being in the form of coiled wire having lower electrical resistivity than said conductive heating portions.

12. The fuse of claim 9 wherein each of said exothermic bodies comprises:

at least one primer body disposed in heat transfer relationship with a respective one of said heating portions, said primer body being formed from a material which releases energy in response to the heating effect of current flowing through said heating portion; and a main body disposed in heat transfer relationship with said pirmer body, said main body being formed from a material which exothermically produces heat energy in repsonse to the energy released by said primer body.

13. The fuse of claim 12 wherein:

said primer body at least partially surrounds said heating portions; and said main body at least partially surrounds said primer body.

14. The fuse of claim 3 further comprising means for providing an arc-extinguishing gas to said fusible elements, said gas providing means disposed so that said gas assists in extinguishing the arcs formed along the length of said fusible elements as a result of said disruption of said fusible element by said exothermic reactions in said exothermic bodies.

15. The fuse of claim 14 wherein:

said means for providing an arc-extinguishing gas comprises at least one gas-evolving member formed from a material which evolves an arc-extinguishing gas when exposed to an electrical arc; and said gas-evolving member disposed sufficiently close to said fusible elements so that exposure of said member to the arcs formed along the length of said fusible elements causes arc-extinguishing gas to be evolved from said member.

16. The fuse of claim 15 wherein a respective one of said gas-evolving members is employed with each of said containment bodies such that the portion of each of said fusible elements situated adjacent to each respective one of said containment bodies is located between said containment body and said associated gas-evolving member.

17. The fuse of claim 9 further comprising means electrically connected in series with said triggering circuit for substantially blocking current from flowing through said triggering circuit under predetermined switching surge conditions and for electrically breaking down and allowing current to flow through said triggering circuit when the voltage across said surge blocking means exceeds a predetermined level.

18. The fuse of claim 17 wherein said surge blocking means comprises an electrical breakdown gap.

19. The fuse of claim 9 further comprising a second triggering circuit connected between said terminals electrically in parallel with said first-recited triggering circuit and with said fusible element, said second triggering circuit having an electrical resistance that limits current therethrough to very low values until said fusible element is disrupted, said second triggering circuit being electrically insulated from said fusible element at all points along the length of said fusible element except at said terminals, said second triggering circuit being further disposed in heat transfer relationship with said exothermic bodies so that the heating effect of current through said second triggering circuit upon disruption of said fusible element causes said exothermic bodies to exothermically react and cause further disruption of said fusible element at additional locations along the length thereof.

* * * * *